US008684571B1

(12) United States Patent
Alaura et al.

(10) Patent No.: US 8,684,571 B1
(45) Date of Patent: Apr. 1, 2014

(54) BOLLARD LIGHT WITH INTERNAL COMPRESSION SUPPORT SYSTEM

(71) Applicants: Greg Alaura, Phoenix, AZ (US); Richard Goeldi, Phoenix, AZ (US)

(72) Inventors: Greg Alaura, Phoenix, AZ (US); Richard Goeldi, Phoenix, AZ (US)

(73) Assignee: Barron Lighting Group, Inc., Phoenix, AZ (US)

( * ) Notice: Subject to any disclaimer, the term of this patent is extended or adjusted under 35 U.S.C. 154(b) by 0 days.

(21) Appl. No.: 13/691,334

(22) Filed: Nov. 30, 2012

(51) Int. Cl.
*F21S 8/00* (2006.01)
*F21S 13/10* (2006.01)

(52) U.S. Cl.
USPC ..... 362/431

(58) Field of Classification Search
USPC ..... 362/431
See application file for complete search history.

(56) References Cited

U.S. PATENT DOCUMENTS 4,814,961 A * 3/1989 O'Brien et al. ..... 362/319

* cited by examiner

*Primary Examiner* — Jason Moon Han
(74) *Attorney, Agent, or Firm* — KC Bean, Esq.

(57) ABSTRACT

A lighted bollard system that has significantly enhanced internal structural strength while providing for the replacement of the outer bollard cover and allows users to select from a plurality of different lighting fixtures suited for different applications.

8 Claims, 8 Drawing Sheets

BOLLARD LIGHT WITH INTERNAL COMPRESSION SUPPORT SYSTEM

RELATION TO OTHER PATENTS

This application is an originally filed application and does not claim priority based on any prior filed application.

FIELD OF THE INVENTION

The present disclosure generally relates to apparatuses, systems and methods in the technical field of bollard lighting systems. More particularly, the present invention relates to a bollard light systems with an internal support structures that use component compression to strengthen and harden the bollard.

BACKGROUND OF THE INVENTION

Lighting bollards have been used broadly in numerous urban, industrial, landscaping and architectural applications. Lighting bollards must be designed to withstand harsh environments, vandalism and they must endure significant day to day abuse over extended periods of times. Many times lighting bollards are designed to be used as barricades for preventing vehicle access. It is common for vehicles to graze or impact the bollard. As such, it is necessary to maintain strength of the bollard while maintaining the aesthetic standards of the surrounding environment.

Manufacturers have used various materials and construction designs to strengthen or harden the bollard and maximize their useful and aesthetic life. Solid, extruded or cast metals and formed concrete with rebar reinforcement and a hollowed axial core have been used. These types of bollards proved to have strength; however, such construction is expensive and if replacement is required because of external impact damage or aesthetic deterioration the expense is exacerbated. Additionally, to mount such bollards requires heavy duty base supports or integration of bollard into the construction of the base platform. This is often times inconvenient and expensive.

Accommodation of lighting components tended to further weaken the bollards or create limitations with the replacement of lighting fixtures. To reduce cost and to better accommodate lighting applications, bollard designs migrated to the use of heavy gauge steel tubing welded to a bottom mounting plate and capped by a permanent lighting fixture. U.S. Pat. Nos. 4,999,749 and 5,075,833 issued to Dormand discloses such a design. One limitation with this type of design is that the upright strength is dependent on the integrity of the tubing structure. If there is any dent in the upright tube caused by an impact the overall strength of the tube is significantly diminished. Additionally, for a bollard that has suffered impact damage to the exterior surface, the entire bollard would still need to be replaced to maintain overall aesthetic appeal in the environment.

Dorman also integrates the lighting fixture into the upright tube and includes louvers welded to outer surface of the tube to disperse light. This is a further disadvantage because it does not allow for easy replacement of the light fixture, which is highly desirable in many applications. It also limits the type of light that can be used because once installed it is prohibitive to replace the type of light originally installed. A number of attempts have been made to overcome these limitations with only partial success. U.S. Pat. No. 6,402,337 issued to LeVasseur et al. discloses a bollard light having an adjustable light distribution pattern. The light distribution pattern is modified by adjustment of a cap assembly that increasingly covers a portion of the light fixture assembly to redirect the light. In order to ease in the replacement of the internal light fixture, LeVasseur discloses an internal frame structure to support the lighting fixture. An external sleeve that is connected to a mounting base by screws and constituting the major body of the bollard covers the internal frame structure, and it can be interchanged with sleeves of different heights. Although it is desirable to have the ability to interchange the outer bollard cover to maintain aesthetic appearance, because of this structure, there is innate weakness in the overall structure of the bollard. Therefore a need exists for a lighted bollard system that provides solutions to the aforementioned deficiencies in the prior art. In view of the foregoing background, the present invention overcomes the limitations of the prior art.

SUMMARY OF THE INVENTION

The present teaching provides a lighted bollard system that has significantly enhanced internal structural strength while providing for the replacement of the outer bollard cover and allows users to select from a plurality of different lighting fixtures suited for different applications. The bollard is constructed with an internal support column having a top side and a bottom side the support column extending the length of the outer housing of bollard. The internal support column incorporates a plurality of column fins radially extending out from the internal support column a distance that allow the central column to snuggly fit within the diameter of the bollard, the fins being permanently affixed to and extending the length of the column. The internal support column also has a permanently affixed mounting plate for mounting the bottom side of the central column to a base plate which is anchored using anchor bolts to a secure surface at the intended location of the bollard.

A bollard housing cover having a top side and a bottom side has a plurality of channel grooves on the interior surface that run the length of the housing and are in alignment with each column fins. The housing cover is fitted over the top side of the internal support column by alignment of the fins with the channel grooves in a tongue and groove fashion and sliding the housing over the length of the column. The housing is then secured to the base plate with tamper resistant screws.

A compression plate having a diameter that allows fitting of the compression plate within the bollard housing is set within the top side of the outer housing cover atop the internal support column. This provides a path for heat transfer with the internal support column acting as a heat sink for heat generated from the LED engine. An upper housing, which includes a lighting source may be chosen from a plurality of housings to suit a particular lighting application, is placed atop the compression plate. The bottom side of the upper housing includes a ring adaptor for securing with screws the upper housing to the body of the bollard. The ring adaptor includes a plurality of tabs that are aligned to fit into the channel grooves on the top side of the housing. The ring adaptor also includes a wedged shaped portions, where, as the screws are tightened on the wedge a downward force is applied to the compression plate, which in turn applies force to the top side of the central column and the fins set within the housing grooves. This force tightens the components of the bollard and ads overall strength to the system as a whole. When screws are tightened at the compression plate and the base, the center support is in compression, which put the outer housing in tension. This action keeps the overall bollard system very rigid adding strength.

In the event that the bollard suffers damage as a result of an impact from a vehicle, the system can be loosened by removing the screws and the bollard housing or upper housing can be easily replaced without replacement of the entire bollard.

Therefore it is an object of this disclosure to provide a light bollard with enhanced internal strength.

In another aspect of this invention, provided is a light bollard with a replaceable outer cover to maintain aesthetic appearance.

In yet another aspect of the invention, provided is a light bollard that allows users to select from a plurality of light fixtures while maintaining the strength and integrity of the bollard.

These and other objects, features and advantages in accordance with the present invention are provided. These aspects of the invention are not intended to be exclusive and other features, aspects, and advantages of the present invention will be readily apparent to those of ordinary skill in the art when read in conjunction with the following description, appended claims and accompanying drawings.

BRIEF DESCRIPTION OF THE DRAWINGS

Embodiments of the present disclosure will be more readily understood by reference to the following figures, in which like reference numbers and designations indicate like elements.

FIG. 4 comprises FIGS. 4A, 4B, 4C and 4D;

FIG. 5 comprises FIG. 5A and FIG. 5B

DETAILED DESCRIPTION OF THE PREFERRED EMBODIMENTS

The present invention will now be described more fully hereinafter with reference to the accompanying drawings in which preferred embodiments of the invention are shown. This invention may, however, can be embodied in many different forms and should not be construed as limited to the illustrated embodiments disclosed. Rather, these embodiments are provided so that this disclosure will be thorough and complete, and will fully convey the scope of the invention to those skilled in the art. Like numbers refer to like elements throughout. The sight adaptor will now be described in detail, with reference made to FIGS. 1-7.

The present invention provide for an apparatus, system and method in the technical field of lighted bollards. In broad embodiment, the present invention is a lighted bollard system using compression techniques to enhance the overall strength, rigidity and durability of the bollard. The advantages of the present invention include, without limitation, that it will improve the strength bollard while maintaining a light weight structure. The invention will allow users flexibility in choosing the type of lighting fix to suit the particular user application. Additionally, the invention will provide a bollard lighting system that provides easy replacement of damaged exterior coverings without compromising the overall strength of the system.

Figure 1:
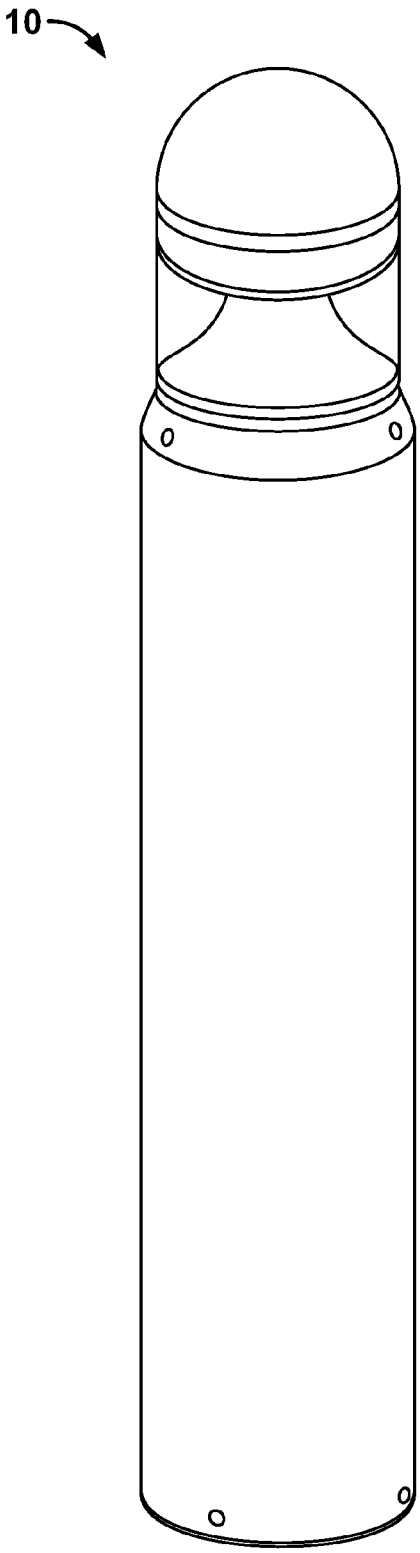
FIG. 1 is a front profile view of the disclosed light bollard.

FIG. 1 shows the lighted bollard 10 of the current invention. The bollard 10 has the external appearance of conventional bollard lights with an internal structure, described below, that provides advantages and benefits over the prior art. Conventional appearance is desirable in that it allows designers and architects to incorporate the inventive bollard without any special handling or disruption to existing architectural or aesthetic designs in the environments in which they are intended to be used.

Figure 2:
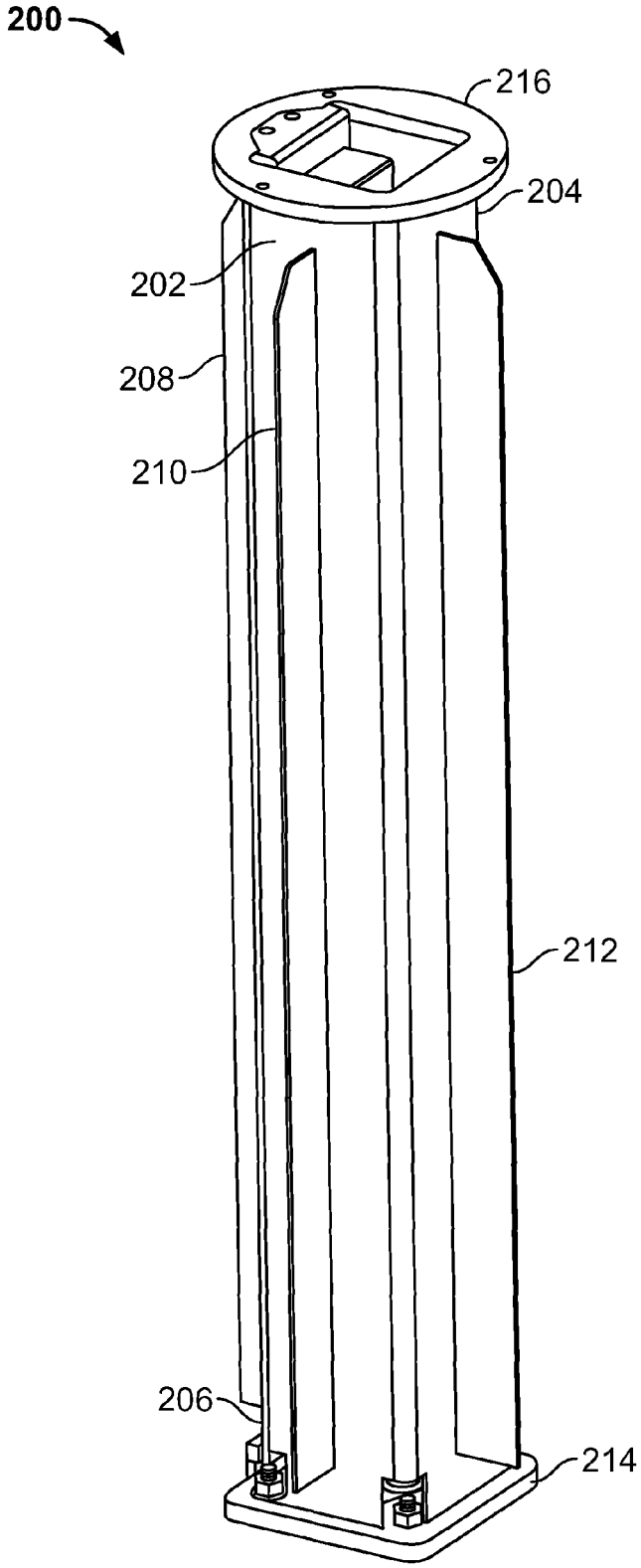
FIG. 2 is a longitudinal view of the center support column.

Now with reference to FIG. 2. The bollard is constructed with an internal support column 200 having a top side 204 and a bottom side 206. The length of the support column 200 extends the longitudinal length of the outer housing of bollard, which is discussed below. The support column 200 is comprised of a central column 202, which in the current embodiment is shown in the shape of a square. A square shaped central column 202 is sufficient for some impact resistance profiles. However, it will be appreciated by one of ordinary skill in the art that a circular column could provide more strength and resistance against impact, or the column could be in the shape of a triangle to reduce material costs. The internal support column 200 can be composed of any material of substantial compression strength. In the current embodiment heavy grade steel is used.

The central column 202 incorporates a plurality of column fins 208, 210 and 212 radially extending out from the central column 202; a fourth is not visible in FIG. 2. The actual number of fins will depend on the strength profile that is desired for the particular application. The distance of each fin from the center column 202 is that distance which allows the internal support column structure 200 to snuggly fit within the diameter of the bollard. The fins are permanently affixed to and extend the longitudinal length of the central column 202. In the preferred embodiment the fins are affixed by welding, but in alternative embodiments the fins and central column may we extruded as a single unit. The central column 202 has permanently affixed to the bottom side 206 a mounting plate 214 for mounting the internal support structure 206 to a base plate. Additional, the top side 204 of the internal support 200 has a top plate 216, which allow for mounting of lighting components within the internal structure of the central column 202.

Figure 3:
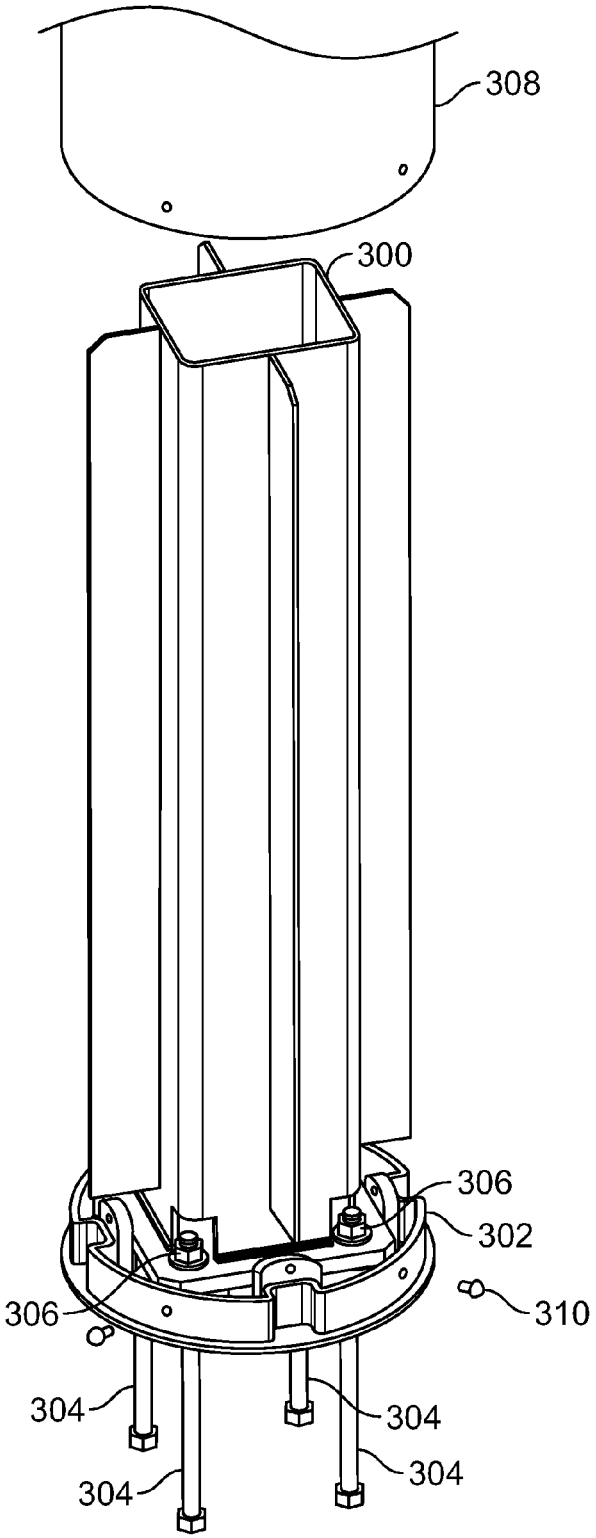
FIG. 3 is a longitudinal view of the center support column, mounted to the mounting plate and a partial view of the outer cover.

Now referring to FIG. 3, illustrated is the internal support column 300 secured to the base plate 302 preferably by four J-bolts 304 tightened by four nuts 306. The base plate 302 is anchored to a permanent location such as a concrete pad by inclusion of the J-bolts into wet concrete or through sync bolts. As described in more detail below, a bollard cover 308 is fitted over the internal support column 300 and affixed to the mounting plate 302 using tamper resistant screws 310.

Figure 4A:
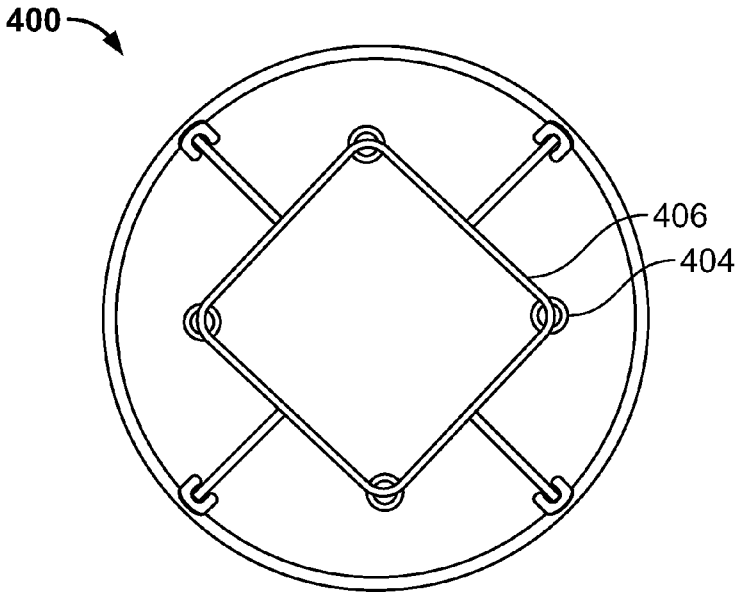
FIG. 4A is a top down view of the mounting plate showing the footprint of the center support column as it would rest on the mounting plate.
Figure 4B:
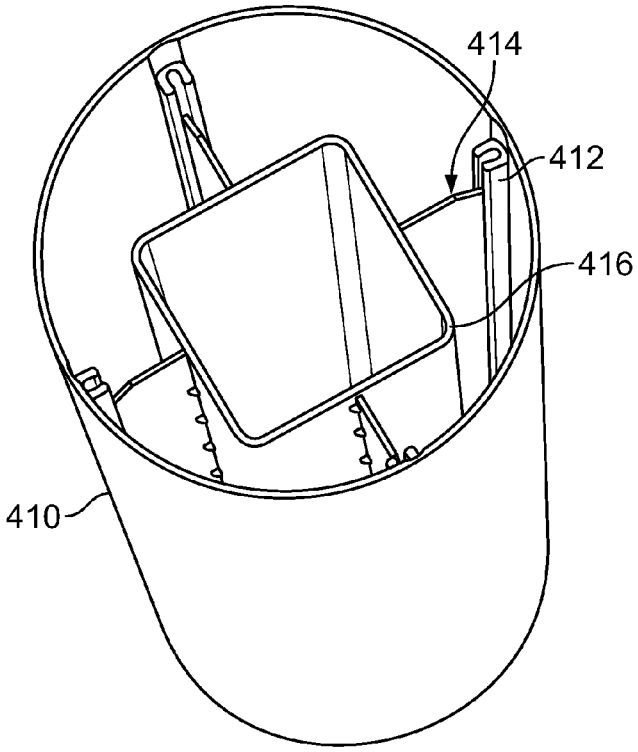
FIG. 4B is a top down view of the center support column with the outer cover fitted.
Figure 4C:
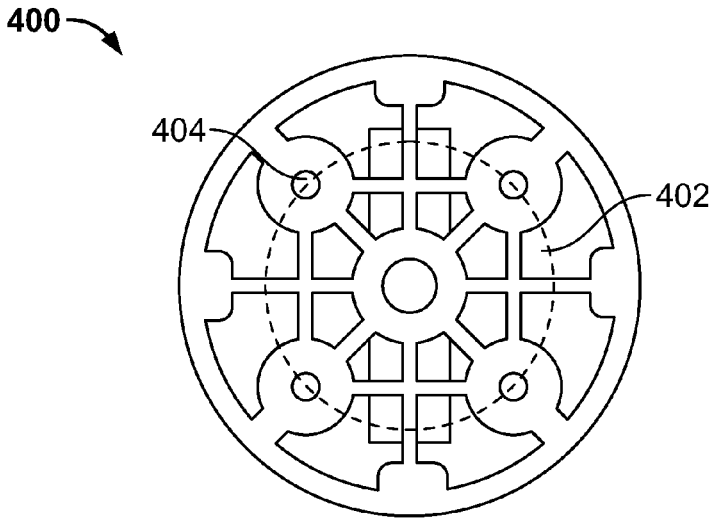
FIG. 4C is a top down view of the base plate.
Figure 4D:
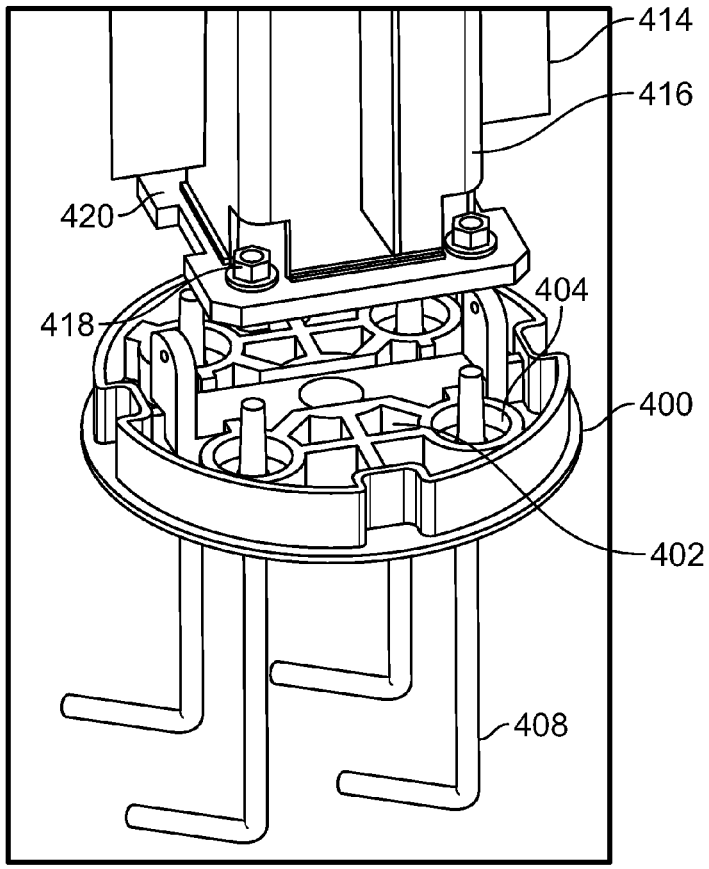
FIG. 4D is a perspective view of the baseplate with the center support column.

FIG. 4A-4D provide additional details regarding mounting the internal support column and fitting the outer housing. FIGS. 4A and 4C illustrate a top down view of the mounting plate 400. FIG. 4D shows a perspective view of the mounting plate 400. The mounting plate is preferably made of tinsel strength metal that is extruded, milled or cast. The mounting plate incorporates a matrix of raised bars 402 that strengthen the overall structure of the plate and provide a base for mounting the internal central column. 4A demonstrates the overlay of the footprint of the internal support column 406 atop of the raised bars 402. The base plate also includes four anchor bold holes 404 for inserting the anchor bolts, shown in 4D. The internal support column 416 is mounted to the base plate 400 by inserting the anchor bolts 408 through the base plate 400 and through the mounting plate 420 of the internal support column 416 using threaded nuts 418.

4B shows a bollard housing cover 410 that has a plurality of channel grooves 412 on the interior surface that run the length of the housing and are in alignment with each column fins 414. The housing cover 410 is fitted over the top side of the internal support column 416 by alignment of the fins 414 with the channel grooves 412 in a tongue and groove fashion and sliding the housing 410 over the length of the column. The housing is then secured to the base plate with tamper resistant screws (not shown).

Figure 5A:
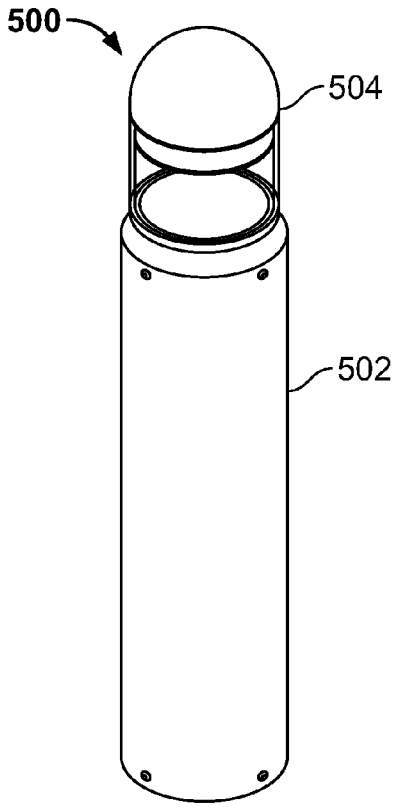
FIG. 5A is a front profile view of the disclosed light bollard.
Figure 5B:
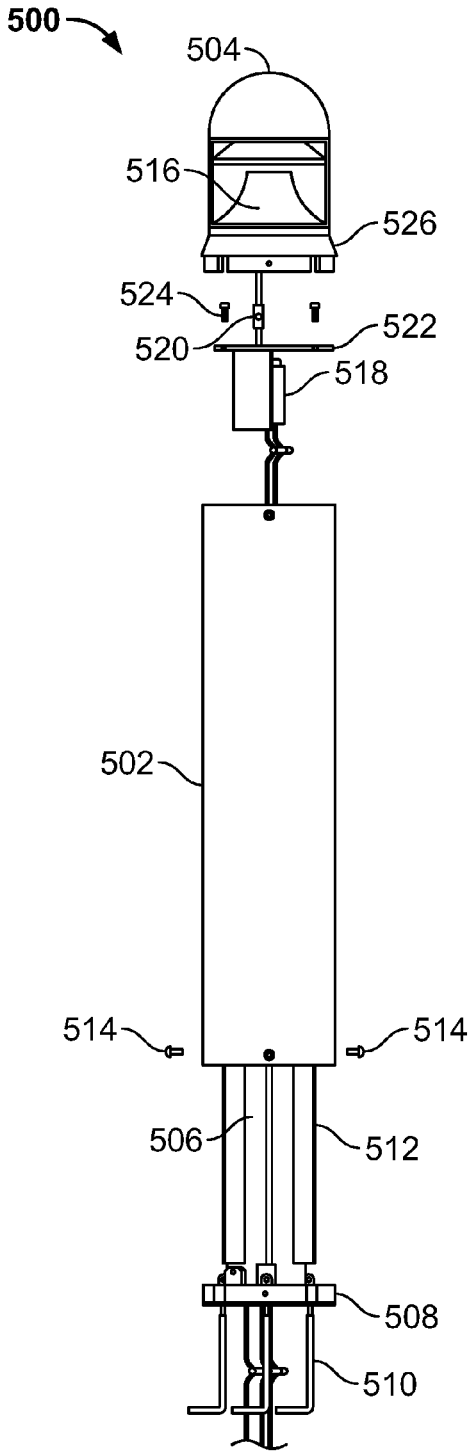
FIG. 5B is a front profile exploded view of the disclosed light bollard.

Now referring to FIGS. 5A and 5B, FIG. 5A illustrates the exterior of the lighted bollard 500 of the current invention. The bollard includes an outer housing 502 and an upper housing 504 that houses the lighting fixture of the bollard. In the preferred embodiment an LED lighting fixture is used; however, it will be appreciated by one skilled in the art that any type of preferred light source may be used. The upper housing 504 can be selected from a plurality of different lighting fixtures having different lighting features and ornamental appearances that are preferred for the particular application in which the bollard with be placed.

FIG. 5B shows the light bollard in an exploded view. As discussed above, the internal support column 506 is bolted to the base plate 508 using anchor bolts 510. The outer housing 502 is fitted over the internal column 506 by sliding in a tongue and groove fashion the internal grooves of the outer housing (not shown) over the fins 512 of the internal column 506. The outer housing is seated over the base plate and secured to the base plate using tamper resistant screws 514.

The lighting fixture 516 is powered by a standard LED power supply 518 connected to the fixture by a connector 520. The power supply 518 is affixed to a compression plate 522 using a bracket and inserted into the central gap of the internal support column 506. The power supply 518 can be affixed using any conventional means such as spot welding or metal adhesive. The affixing of the power supply does not add to the overall strength of the bollard and is done merely to utilize the available interior space. The compression plate 522 has a diameter that allows fitting the compression plate within the bollard housing 502 to be secured to the top plate of the internal support column 506. Affixed by screws 524 to the bottom side of the upper housing 504 is a ring adaptor 526 for securing the upper housing to the body of the bollard.

Figure 6:
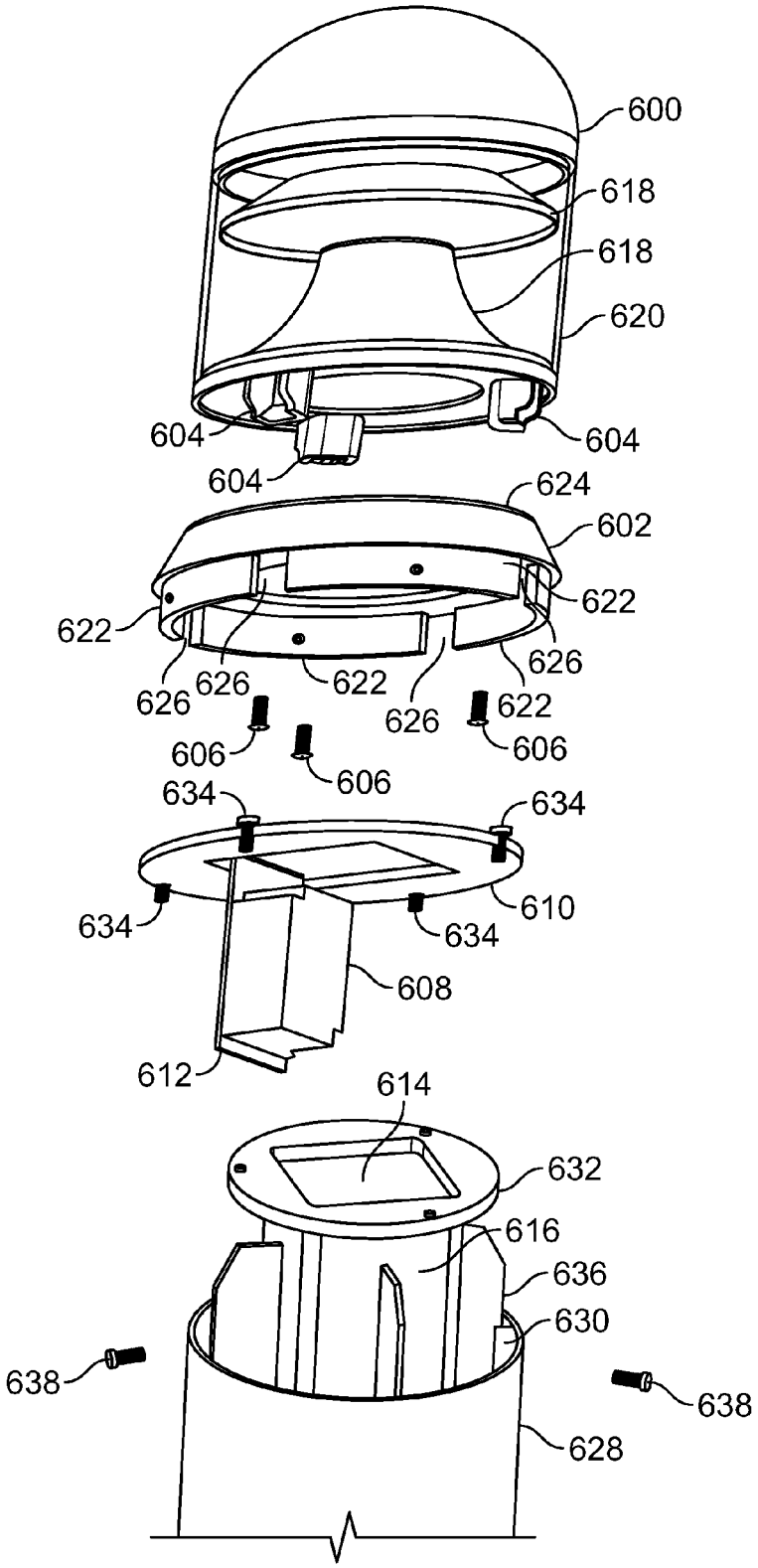
FIG. 6 is an exploded perspective view of the upper portion of the present invention.

FIG. 6 further illustrates the attachment of the upper housing body 600 and ring adaptor 602 to the body of the bollard. The upper housing body 600 includes a lighting fixture and at the lower portion of the body a plurality of tabs 604 with threaded holes that are aligned to holes in the ring adaptor 602. Screws are used to secure the ring adaptor 602 to the upper housing body 600. This design allows for the attachment of an upper housing body of essentially any configuration so long as the tabs 604 are properly align with the holes in the ring adaptor 602.

In the current embodiment the lighting fixture is a standard LED light configuration with protective lens 620 and reflective surfaces 618 for dispersing the light. The power supply with an enclosed LED driver 608 is affixed to the compression plate 610 using a bracket assembly 612 that is spot welded to the compression plate 610. The power supply assembly 612 is inserted into the open space 614 of the central column 616. The surface area of the assembly 612 is maximally in contact with the inner surface of the central column 616, which provides a path for heat transfer of heat generated by the LED engine to the central column 616 and fins 636. The power supply is connected to the light fixture using a connector and standard wiring between 120 VAC and 277 VAC. The wiring runs the length of the interior support column 616 and through the base plate (not shown) and is connected to a standard 120V or other conventional power source. The compression plate 610 is secured to the top plate 632 of the support column 616 using screws 634.

The ring adaptor 602 comprises a plurality of tabs 622 extending from the upper portion 624 of the ring adapter and with gaps 626 between each tab 622. The tabs are thinner than the upper portion 624 and are seated into the outer housing 628 between each of the grooves 630 on the interior surface of the outer housing when the system is fully constructed. The gaps 626 between the tabs 622 are spaced so that the grooves 630 and fins 636 fit snuggly into each respective gap for a firm and concise fit of components.

The upper housing is secured to the main body of the constructed bollard by fitting the tabs 622 of ring adapter 602 within space of the interior of the outer housing and the gaps 626 of the ring adapter fitted over the grooves 630. Screws 638 are used to secure the upper housing to the main body of the bollard.

Figure 7:
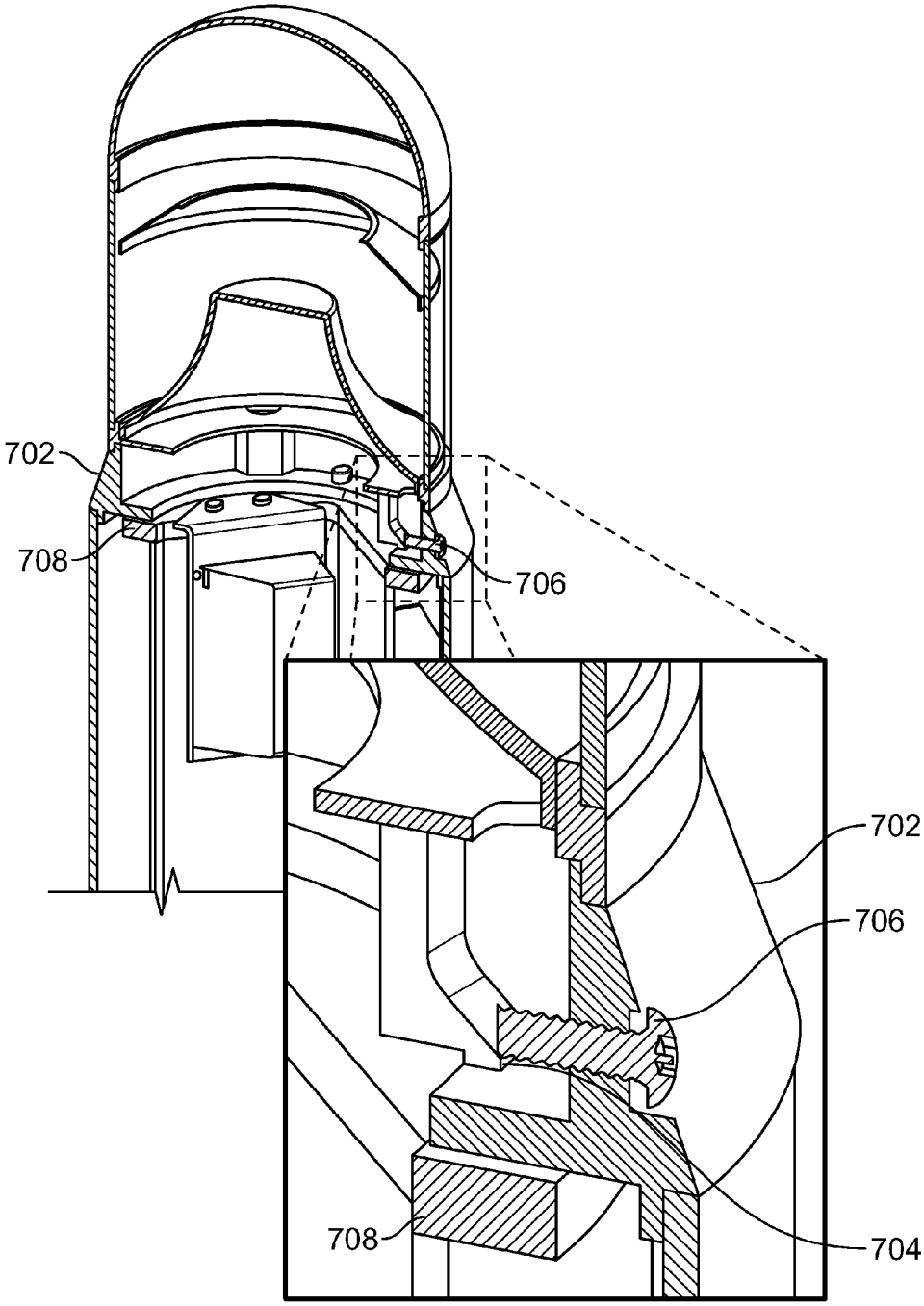
FIG. 7 is a expanded sectional view of the compression ring.

Now with reference to FIG. 7, the ring adaptor 702 includes a wedged shaped inner circular band 704 that runs parallel to the outer surface of the ring adaptor 702. As the screws 706 are tightened on the wedge to secure the upper housing to the bollard a downward force is applied to the compression plate, which in turn, applies a downward force to the top plate of the central column and the fins set within the housing grooves. This force tightens all of the internal components of the bollard and significantly adds to the overall strength of the system as a whole without increasing the weight or requiring additional materials for construction.

It will be appreciated by one skilled in the art that the disclosed invention is preferable over the prior art because the current disclosure provides a strong but lighter weight option over existing lighted bollards. The currently disclosed bollard uses less overall material in construction than known bollards of similar strength, and thus it is less costly to manufacture. The current invention is also preferable in that if a user desires to modify or change the appearance of the bollard or the lighting effect after installation to make more contemporary with the changing environment, one only needs to replace the upper housing without sacrificing any structural strength or integrity. Further, in the event that the bollard suffers damage as a result of an impact from a vehicle, the system can be loosened by removing the screws and the bollard outer housing can be easily replaced without a need for replacement of the entire bollard. In some embodiments of the current invention it may be preferable or required in some applications that the bollard has more strength than the disclosed embodiment. It is contemplated that a circular central column or a cantilever mechanism associated with the compression plate and the base plate may be used to further enhance strength. The cantilever design uses a thin high strength wire that can be drawn through various components of the support structure and housings and then tightened using a screw and ratchet. As the screw is turned the system is tightened on multiple points adding strength to the overall system.

While the above description of the invention enables one of ordinary skill to make and use what is considered presently to be the best mode thereof and has pointed out novel features of the present disclosure as applied to various embodiments, the skilled person will understand that various omissions, substitutions, combinations, permutations, changes and equivalents in the form and details of the present teachings illustrated may be made without departing from the scope of the present teachings.

Each claim set forth below is intended to encompass any apparatus or method that differs only insubstantially from the literal language of such claim, as long as such apparatus or method is not, in fact, an embodiment of the prior art. To this end, each described element in each claim should be construed as broadly as possible, and moreover should be understood to encompass any equivalent to such element insofar as possible without also encompassing the prior art. Furthermore, to the extent that the term "includes" is used in either the detailed description or the claims, such term is intended to be inclusive in a manner similar to the term "comprises"

What we claim is:

1. A lighted bollard system comprising:

an internal support column, an outer housing, an upper housing, a base plate, a ring adaptor and a compression plate;

the internal support column having a top side and a bottom side and being comprised of a central column extending longitudinally the length between the top side and the bottom side, a mounting plate is affixed to the bottom side for mounting the bottom side to the base plate, the internal support column is further comprised of a plurality of rigid support structures extending the length between the top side and the bottom side and that interface with the central column in a manner that allow the central column to snuggly fit within the diameter of the outer housing;

the outer housing having a top side and a bottom side and having a plurality of channel grooves on the interior surface that run the length of the housing and are in alignment with each of said support structures, the outer housing a shape and size sufficient to fit over the top side of the internal support column by alignment of the support structures with channel grooves in a tongue and groove fashion and sliding the outer housing over the length of the internal column and secured to the base plate;

the base plate having a shape and size that provides for securing of the base plate within the bottom side of the outer housing, the base plate affixed to the mounting plate of the internal support column and is capable of being anchored to a surface at the intended location of the bollard;

the upper housing has a lighting source associated with a power supply, said upper housing being affixed atop the compression plate and the bottom side of the upper housing including said ring adaptor for further securing the upper housing to the body of the bollard;

the compression plate having a shape and size that is adapted for securing the compression plate within the top side of the outer housing and affixing the bottom side of the upper housing, wherein as the upper housing is affixed a force is applied to the compression plate, transferring force to the top side of the central column and the support structures set within the channel grooves; said compression plate increasing the internal compression strength of the bollard.

2. The bollard of claim 1, wherein the internal support column is made of a heat transfer material and provides a path for heat transfer from the light source or power supply to the outer housing and the internal support column acting as a heat sink.

3. The bollard of claim 1, wherein the outer housing of the bollard is replaceable.

4. The bollard of claim 1, wherein the plurality of rigid support structures extending the length between the top side and the bottom side are fins, said fins also extending radially from the central column a distance that allows the internal support column structure to securely fit within the outer housing.

5. The bollard of claim 1, wherein the plurality of rigid support structures extending the length between the top side and the bottom side substantially surround the support column, said rigid support structures significantly conforming to the shape and size of the central column and extending from the central column to securely fit within the channel grooves.

6. The bollard of claim 1, wherein, said ring adaptor includes a plurality of tabs that are aligned to fit into the channel grooves on the top side of the outer housing.

7. The bollard of claim 1, wherein the upper housing is selected from a plurality of housing choices each having a different visual or lighting source option.

8. The bollard of claim 1, wherein the ring adaptor includes at least one tension generating portion selected from a group consisting of a tension wedge, compression screw or cantilever.

* * * * *